United States Patent [19]

Osborne

[11] Patent Number: 4,471,947

[45] Date of Patent: Sep. 18, 1984

[54] FENCE CONSTRUCTION

[76] Inventor: Charles W. Osborne, 515 W. Burchett St., Glendale, Calif. 91203

[21] Appl. No.: 486,601

[22] Filed: Apr. 19, 1983

[51] Int. Cl.[3] ..... E04H 17/16

[52] U.S. Cl. ..... 256/24; 256/65; 256/69

[58] Field of Search ..... 256/24, 25, 47, 65, 256/69

[56] References Cited

U.S. PATENT DOCUMENTS

| | | | |
|---|---|---|---|
| 3,089,681 | 5/1963 | Smithwick | 256/47 |
| 3,471,129 | 10/1969 | Mpakarakes | 256/24 |
| 3,903,363 | 6/1975 | Bohon | 256/24 X |
| 3,960,367 | 6/1976 | Rogers | 256/65 X |
| 4,078,772 | 3/1978 | Carbone | 256/24 |
| 4,262,882 | 4/1981 | Simcoe et al. | 256/24 X |

*Primary Examiner*—Andrew V. Kundrat

*Attorney, Agent, or Firm*—Nilsson, Robbins, Dalgarn, Berliner, Carson & Wurst

[57] ABSTRACT

A modular fence construction includes a plurality of panels which extend between adjacent fence posts and are releasably connected to the posts. In a preferred embodiment, the panels are fabricated before being connected to the posts and can be selectively removed from the fence. The panels are preferably connected to the posts by a plurality of brackets having screw thread connectors.

8 Claims, 4 Drawing Figures

FENCE CONSTRUCTION

BACKGROUND OF THE INVENTION

This invention relates to the construction art and, more particularly, to a modular fence construction in which segments of the fence can be selectively removed and replaced without damage.

Fences have historically been designed as more or less permanent structures, without providing for subsequent removal or alteration. They have been built from available fencing materials, such as chain link or raw lumber, yielding integrated structures which cannot be dismantled without damaging the materials. Thus, conventional wood fences are constructed entirely with nails and cannot be dismantled without damage.

Because most fences are constructed "on site"as unitary structures, the process of construction is labor intensive and quite expensive. Wood fences constructed in this manner from raw lumber can also be non-uniform in appearance, detracting from their esthetic qualities.

Conventional wood fences, thought by many to be the most attractive prior fences, also suffer from the deteriorating effects of termites and the weather. This is particularly true when wooden posts supporting a fence are anchored in the ground. If the posts fail, the entire fence is rendered useless. Although anchoring the posts in concrete can postpone these effects, it does not eliminate them.

Therefore, it is desirable in many applications to provide an esthetically pleasing fence which is relatively inexpensive and durable, yet can be dismantled and reassembled in sections, if desired.

SUMMARY OF THE INVENTION

The present invention comprises a fence arrangement and manufacturing method which include: a plurality of vertical posts positioned at spaced locations along a predetermined fence line; a plurality of panel assemblies extending between respective pairs of the posts; and means for releasably connecting the panel assemblies to the posts. In a preferred embodiment, the panel assemblies are fabricated prior to being connected to the posts, and the connecting means is constructed and arranged to permit selective removal of the panel assemblies. Also in a preferred embodiment, the posts are metallic and the panel assemblies are primarily wooden, comprising at least two horizontal support beams and a plurality of vertical planks extending between the support beams. The connecting means may then comprise at least one bracket carried by each post, and means for releasably affixing adjacent panels to the bracket. Each bracket preferably comprises a clamping portion extending substantially about one of the posts, and at least one flange portion connectable to adjacent panel assemblies.

In the method of the present invention, the posts are installed and the panel assemblies are fabricated prior to the final construction phase. The panel assemblies are then positioned between the posts and releasably connected them to them.

The fence of the present invention is highly attractive, yet fully modular in construction. The panel assemblies can be fabricated away from the posts with a minimum of labor, and the finished fence structure can be selectively dismantled. If the owner wishes to take part or all of the fence down for a period of time, he can do so by removing the bolts or other connectors affixing the panel assemblies to the posts. The integrity of the panel assemblies is not compromised in this process, enabling them to be replaced easily to reconstruct the fence. Such removal and replacement might be desired to provide a temporary path through the fence, such as a path for children or animals which would otherwise be confined by the fence. The construction therefore permits the fence to be readily adapted to changing needs.

The fence is durable because the posts are made of steel which will not fail under normal conditions. The fence posts and metallic connectors can be protected from the elements by a suitable coating process, such as the blue zinc or hot dipped galvanizing processes, and the wood of the panel assemblies can be protected by a wood preservative. The fence is then essentially impervious to weather and can provide years of service and lasting beauty.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
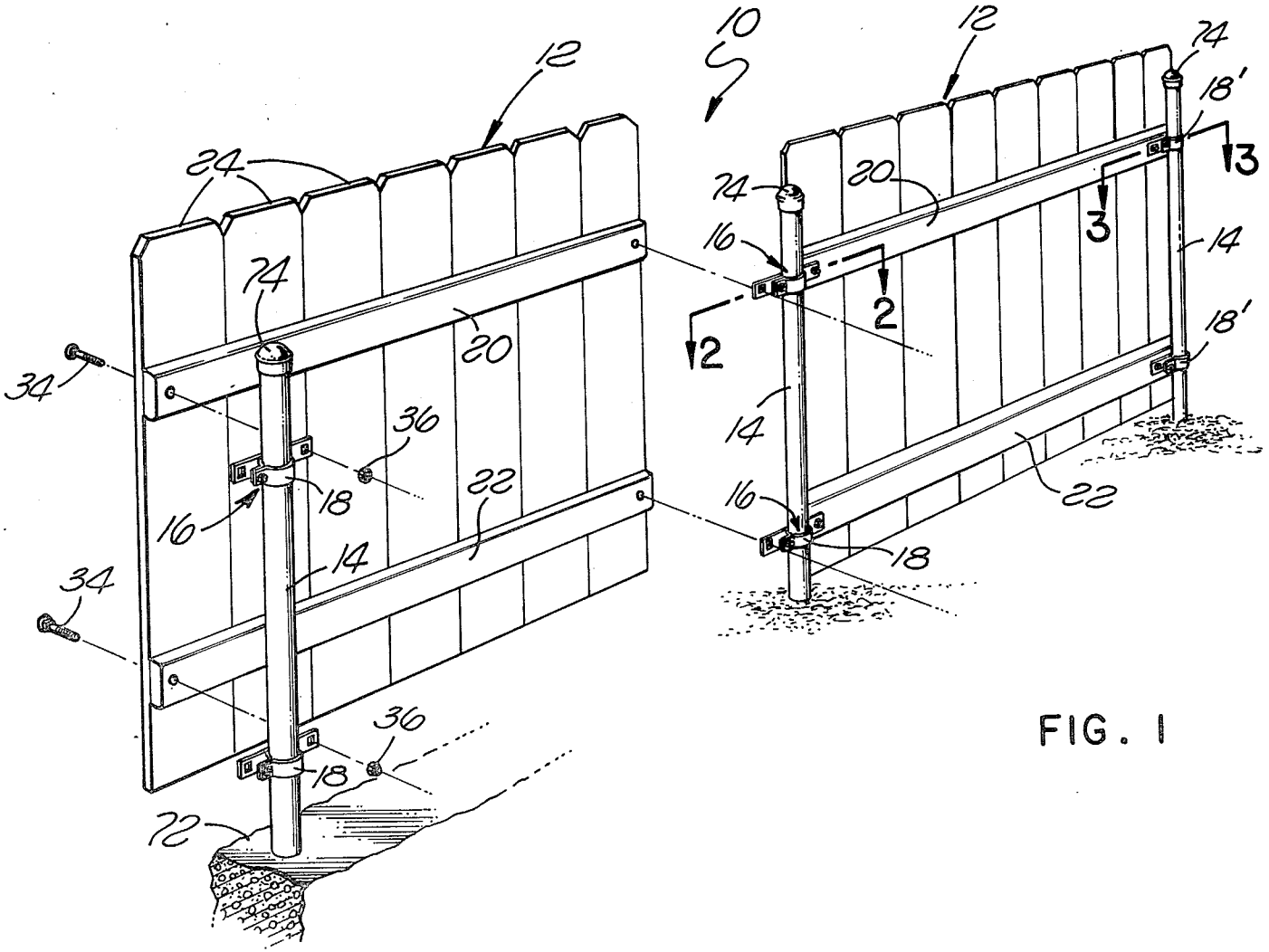
FIG. 1. an exploded perspective view of a fence constructed according to a preferred embodiment of the present invention.

FIG. 1 illustrates a fence 10 constructed according to a preferred embodiment of the invention. The fence comprises a plurality of panel assemblies 12 connected to a series of vertical support posts 14 by releasable connectors 16. In the preferred embodiment, the panel assemblies 12 are wooden, the support posts are metallic, and the connectors 16 include brackets 18 engageable with the posts and the panel assemblies. Each panel assembly is an integral structure which can be removed from the posts to provide a gap in the fence. If desired, the entire fence can be dismantled by removing the panel assemblies, leaving only the support posts 14.

Figure 4:
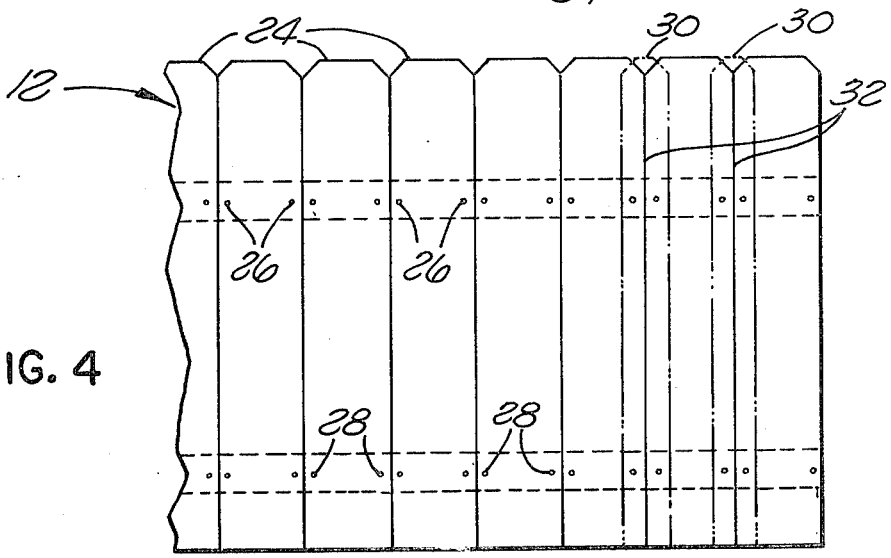
FIG. 4 is a fragmentary front elevational view of a panel assembly constructed according to the preferred embodiment.

Each panel assembly comprises an upper support beam 20 and a lower support beam 22 extending horizontally between connector brackets 18 of adjacent support posts. Fence boards or planks 24 are affixed to the support beams to form the surface of the fence. This configuration is illustrated more clearly in FIG. 4, wherein each fence board is connected to the upper support beam by a pair of nails or other fasteners 26 and to the lower support beam by a pair of nails or other fasteners 28. The boards can be placed side-by-side, as shown at the left-hand side of FIG. 4, or may be applied in any other desired configuration, such as an overlapped, staggered, or spaced pattern. For example, a pair of auxiliary boards 30, shown in phantom lines at the right hand side of FIG. 4, can be applied to overlap the joints 32 between adjacent fence boards. In this case, the auxiliary boards 30 can be narrower than the fence boards 24 to expose a portion of the fence boards therebetween. Thus, the arrangement of boards can be chosen to give the fence any of a wide variety of different appearances, without deviating from the basic structure of the invention.

Figure 2:
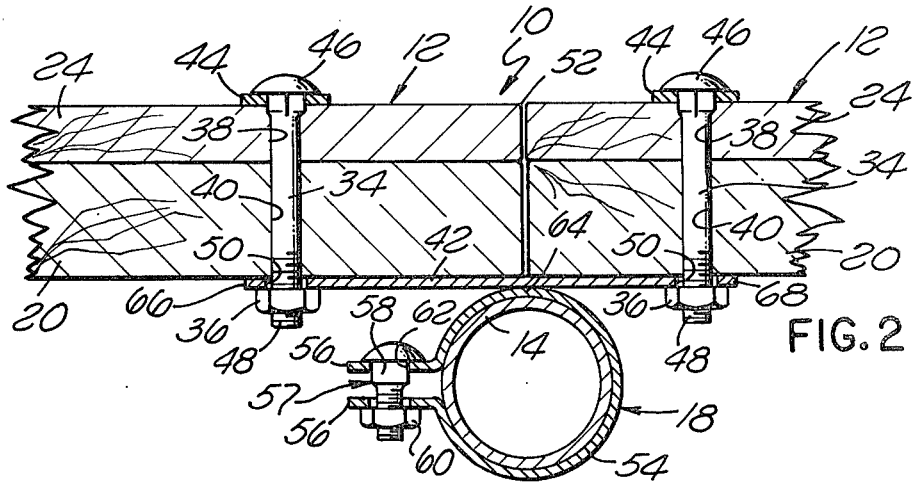
FIG. 2 an enlarged fragmentary horizontal sectional view taken along the line 2-13 2 of FIG. 1, showing the releasable connectors of the invention.
Figure 3:
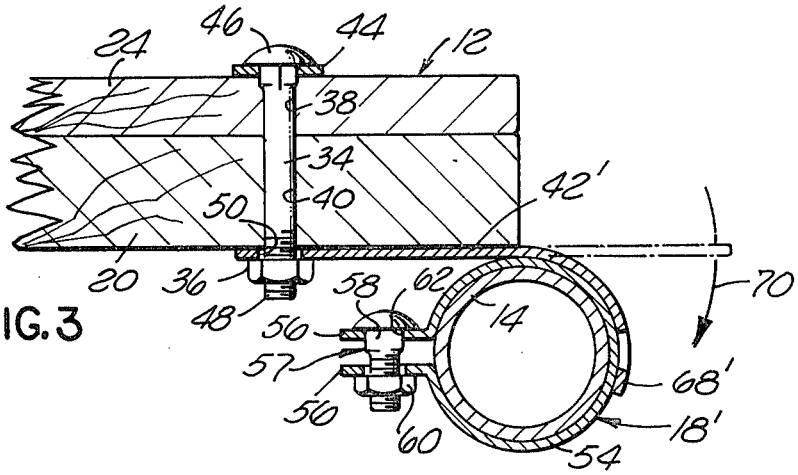
FIG. 3. an enlarged fragmentary sectional view taken along the line 3—3 of FIG. 1, showing the releasable connectors at on of the fence.

The details of the connection between the panel assemblies and the support posts is shown in greater detail in FIGS. 2 and 3. FIG. 2 illustrates a pair of adjacent panels 12 terminating at a single support post, as encountered at locations between the ends of the fence. The upper bracket 18 is carried by the support post and engages the panels 12 at the height of the upper support beams 20. It is connected to the panels by a pair of carriage bolts 34 and nuts 36. Each of the bolts is passed inwardly from the face of the corresponding panel assembly, through openings 38 and 40 of the fence board 24 and the support beam 20, respectively, to engage a flange portion 42 of the bracket. A load bearing washer 44 is provided at the head 46 of the bolt to distribute compressive forces, and the threaded end 48 of the bolt extends through openings 50 of the flange portion 42 for engagement with the nut 36. In this configuration, the fence boards and the support beams of the two panel assemblies are held in abutting relationship along a line 52.

The connector bracket 18 also has a circular clamping portion 54 to clamp the bracket about the appropriate post 14. While the flange portion 42 is straight, the clamping portion extends circularly about the support post and terminates in a pair of ears 56 which are drawn together by a threaded fastener 57 comprising a carriage bolt 58 and a nut 60. The carriage bolt extends through a pair of openings 62 of the ears 56 to clamp the bracket about the post.

In the preferred embodiment, the flange portion 42 and the clamping portion 54 are made of metallic strap material welded together at a location 64 so that the flange portion is essentially tangential to the clamping portion. Thus, the connector bracket 18 may be a commercially available bracket sold for use in chain link fencing. In that case, the two portions of the bracket will generally be $\frac{1}{8}$-inch thick galvanized steel strap approximately 1-inch wide, and may be connected together by fusion welding at the location 64. The straight flange portion 42 will then have first and second end portions 66 and 68, respectively, extending different distances horizontally from the location 64. The first end portion extends further away from the location 64 than does the second end portion, providing access to the associated opening 50 without obstruction by the ears 56. This facilitates assembly and disassembly of the fence arrangement 10.

FIG. 3 illustrates a modified bracket 18′ for connection of the panel assemblies to the posts at either end of the fence. The bracket has a second end portion 68′ which is bent in a direction 70 from an initial condition, shown in broken lines, to a final condition, shown in full lines. This is done for safety reasons because the second end portion 68′ is not used in this mode. Otherwise, the bracket 181 is identical to the bracket 18. The end of the fence is defined by the exposed side of the last board 24 and the ends of the two support beams.

Referring again to FIG. 1, the fence 10 is constructed by building the panel assemblies 12, installing the support posts 14 and attaching the panel assemblies to the support posts. The panel assemblies are either prefabricated at a remote location or fabricated at the job site from raw lumber. In either case, they will generally be built before application to the support posts. Construction of the panel assemblies entails arrangement of the support beams in a preselected spaced relationship and attaching the boards 24 to the beams with nails or other fasteners. This can be accomplished by a single worker by laying the structure out on a horizontal surface. The openings 38 and 40 may be drilled at this time for reception of the carriage bolts 34. The support posts 14 are then installed in the ground at spaced locations along the fence line, and are preferably anchored within concrete footings 72. The support posts are spaced a distance equal to the length of the panel assemblies, and a pair of connector brackets 18 are installed on each of the posts. A raincap 74 is provided at the top of each support post to prevent water from entering the posts. The panel assemblies are mounted to the connector brackets of adjacent posts by standing the panels up so that the carriage bolts extend through the openings 50 of the connector brackets. The assemblies are then anchored in this position by the carriage bolts and nuts at four locations around each panel. The panels are thus applied sequentially to the support posts to construct the fence. Each panel assembly is held in place by a relatively few nuts, and can be selectively removed without damaging the panels.

In a preferred embodiment, the panel assembly is fabricated of redwood, cedar or other suitable lumber, with the supporting beams 20 and 22 being nominally 2 inches by 4 inches in cross-section and the boards 24 being nominally 1 inch in thickness. The panel assemblies 12 may be approximately $7\frac{1}{2}$ feet long and 3 to 6 feet high, depending upon the requirements of the installation. The support posts 14 may then be galvanized steel posts having an outside diameter of $2\frac{3}{8}$ inches and a wall thickness of at least 0.069 inches. Such posts are commercially available under the designations "156A", "166A", "176A", "SS20", and "SS40".

The following list is provided as an example of fasteners suitable for use in the preferred embodiment described above. In each case, the fasteners should be provided with a suitable coating to inhibit corrosion, such as a blue zinc coating or a hot dip galvanized coating.

Fasteners 26 and 28—6 or 8 penny nails
Bolts 34—$\frac{3}{8}$ inch - 16 by $2\frac{1}{2}$ inch carriage bolts
Nuts 36—$\frac{3}{8}$ inch - 16 (USS) double chamfered hex nuts
Washers 44—$\frac{3}{8}$ inch flat washers
Bolts 58—5/16 inch - 16 by $1\frac{1}{4}$ carriage bolts
Nuts 60—5/16 inch - 16 hex nuts In an alternative embodiment, the carriage bolts 34 may be provided to extend only through the support beam 20. As the nut 36 is tightened the head 46 of the carriage bolt 34 is pulled into the wood of the beam 20 to thereby effectively countersink the head of the carriage bolt 34. A board 24 can then be placed over the head 46 and nailed to the beam 20 to thereby hide the head 46 from view.

From the above, it can be seen that there has been provided a relatively inexpensive, yet esthetically pleasing, modular fence construction which permits discrete panel assemblies of several feet in length to be erected or dismantled on a selective basis relative to a number of vertical support posts. The fence is also durable and highly resistant to the elements.

While certain specific embodiments of the invention have been disclosed as typical, the invention is of course not limited to these particular forms, but rather is applicable broadly to all such variations as fall within the scope of the appended claims. As an example, the panel assemblies may deviate from the double support beam structure shown in the drawings, as long as they have at least two reinforced locations at either end for mounting to the support posts. Similarly, the fence boards can be given any desired ornamental configuration without deviating from the scope of the present invention. Thus, the upper ends of the fence boards can, for example, be flat, pointed or V-shaped, rather than having the "dog-eared" shape illustrated in the drawings.

What is claimed is:

1. A modular fence construction comprising:

a plurality of vertical metal posts positioned at spaced locations along a predetermined fence line;

a plurality of wooden panel assemblies extending between respective pairs of the posts, each panel assembly comprising at least two horizontal support beams and a plurality of vertical planks joining the beams; and means for releasably connecting the panel assemblies to the posts, comprising:

at least two bracket means engaging each post, said bracket means having clamping portions extending about the posts and overlying flange portions extending tangentally therefrom and engaging the horizontal support beams of the panel assemblies; and a plurality of screw thread connectors affixing the horizontal support beams to the flange portions;

such that the panel assemblies can be selectively removed from and remounted to the fence without damage.

2. The fence construction of claim 1 wherein:

the metal posts are tubular; and the clamping and flange portions of the bracket means are made of metallic strap material.

3. The fence construction of claim 1 wherein:

the flange portions engage vertical side surfaces of the support beams and are attached thereto by bolts passing through the flange portions and the support beams.

4. The fence construction of claim 3 wherein:

the flange portions are positioned at the sides of the posts to hold the panel assemblies in end-to-end abutting relationship alongside the posts.

5. The fence construction of claim 3 wherein:

each bracket means engaging two adjacent panel assemblies has a pair of flange portions extending in opposite directions within a vertical plane; and each bracket means engaging a panel assembly at an end of the fence line has a single flange portion within said vertical plane.

6. The fence construction of claim 1 wherein:

the clamping portions of the brackets comprise arcuate strape elements which extend about the posts and have two ends drawn together by screw thread means to secure the brackets to the posts; and the screw thread means are actuable between a loosened condition in which the brackets are slidable vertically along the posts, and a tightened condition in which the brackets are fixed relative to the posts;

whereby the brackets and the panel assemblies can be adjusted vertically relative to the posts.

7. A modular fence construction comprising:

a plurality of tubular metal posts positioned vertically at spaced locations along a predetermined fence line;

a plurality of wooden panel assemblies extending between respective pairs of the posts, each panel assembly comprising at least two horizontal support beams and a plurality of vertical planks joining the beams; and means for releasable connecting the panel assemblies to the posts, comprising:

at least two bracket means engaging each post, said brackets having clamping portions extending about the posts and flange portions engaging vertical side surfaces of the support beams, the flange portions being releasably attached to the support beams by bolts passing through the flange portions and the support beams;

the brackets that engage two adjacent panel assemblies having pairs of flange portions which extend in opposite directions within a vertical plane, and the brackets that engage a panel assembly at an end of the fence line having single flange portions within said vertical plane; and the flange portions being positioned at the sides of the posts to hold the panel assemblies in end-to-end abutting relationship alongside the posts;

such that the panel assemblies can be selectively removed from ang remounted to the fence without damage.

8. The fence construction of claim 7 wherein:

the clamping portions of the brackets comprise arcuate strap elements which extend about the posts and have two ends drawn together by screw thread means to secure the brackets to the posts; and the screw thread means are actuable between a loosened condition in which the brackets are slidable vertically along the posts, and a tightened condition in which the brackets are fixed relative to the posts;

whereby the brackets and the panel assemblies can be adjusted vertically relative to the posts.

* * * * *